US012193573B2

(12) United States Patent
Jan

(10) Patent No.: US 12,193,573 B2
(45) Date of Patent: Jan. 14, 2025

(54) MATTRESS FOUNDATION AND PROCESS OF MANUFACTURE

(71) Applicant: Dreamwell, Ltd., Atlanta, GA (US)

(72) Inventor: Francis Jan, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 437 days.

(21) Appl. No.: 15/683,854

(22) Filed: Aug. 23, 2017

(65) Prior Publication Data

US 2019/0059600 A1 Feb. 28, 2019

(51) Int. Cl.

*A47C 19/02* (2006.01)
*A47C 19/12* (2006.01)
*A47C 23/00* (2006.01)

(52) U.S. Cl.

CPC ..... *A47C 19/021* (2013.01); *A47C 19/12* (2013.01); *A47C 23/005* (2013.01); *A47C 19/025* (2013.01); *A47C 19/126* (2013.01)

(58) Field of Classification Search

CPC ..... A47C 19/012; A47C 19/12; A47C 19/025; A47C 19/126; A47C 23/00; A47C 23/005; B65D 5/20; B65D 65/40; B65D 25/34; B65D 25/36

See application file for complete search history.

(56) References Cited

U.S. PATENT DOCUMENTS 3,735,432 A * 5/1973 Kreten ..... A47C 27/085 5/680
3,913,154 A * 10/1975 Sweeney ..... A47C 19/021 5/186.1
4,145,779 A * 3/1979 Eide ..... B68G 7/051 5/737
4,696,071 A * 9/1987 Santo ..... A47C 27/085 5/400
4,970,743 A * 11/1990 Wride ..... A47C 27/085 5/201
5,144,706 A * 9/1992 Walker ..... A47C 19/005 24/DIG. 52

(Continued)

OTHER PUBLICATIONS

International Search Report mailed Oct. 24, 2018 for Application No. PCT/US18/46005 (4 pages).

(Continued)

*Primary Examiner* — Justin C Mikowski
*Assistant Examiner* — Morgan J McClure
(74) *Attorney, Agent, or Firm* — CANTOR COLBURN LLP

(57) ABSTRACT

Partially assembled mattress foundations, assembled mattress foundation and methods of manufacture generally include laminating a single piece fabric covering to a foundation frame including a planar support, side fame members, and transverse frame members. During assembly, the laminated fabric covering functions as a hinge such that the operator can fold the various side frame members and transverse frame members about a peripheral edge of the planar support to perpendicular orient the frame members relative to the planar support and form a rectangular shaped fabric covered foundation frame. Corner guards are attached to respective ends of the side frame members and the transverse frame members to form the corners of the foundation frame, wherein the respective ends are at 90 degrees relative to one another, and wherein the corner guard can include an arcuate exterior face.

6 Claims, 3 Drawing Sheets

(56) References Cited

U.S. PATENT DOCUMENTS 5,210,890 A * 5/1993 Hagglund ..... A47C 23/007 5/239
5,469,589 A * 11/1995 Steed ..... A47C 19/005 5/201
5,628,080 A * 5/1997 Quintile ..... A47C 19/021 40/299.01
5,937,458 A * 8/1999 DeRosa ..... A47D 15/008 5/424
6,510,571 B1 * 1/2003 Tittle ..... A47C 19/04 5/200.1
6,948,199 B2 * 9/2005 Hooper, Jr. ..... A47C 19/025 5/200.1
7,003,822 B1 * 2/2006 Sheehy ..... A47C 19/005 5/200.1
8,167,012 B2 * 5/2012 Hicks ..... A47C 19/005 144/329
8,171,581 B2 * 5/2012 Agarwall ..... A47G 9/0246 5/482
D809,843 S * 2/2018 Keeley ..... D6/718
2004/0055086 A1 * 3/2004 Owens, Jr. ..... A47C 19/00 5/202
2005/0081301 A1 * 4/2005 Watson ..... A47C 27/00 5/739
2006/0031995 A1 * 2/2006 Barkhouse ..... A47C 27/15 5/690
2007/0256246 A1 * 11/2007 Gladney ..... A47C 31/001 5/737
2011/0010863 A1 * 1/2011 Rubio ..... A47C 20/026 5/652
2011/0209288 A1 9/2011 Quinter et al.
2011/0247138 A1 10/2011 Clenet et al.
2018/0027977 A1 * 2/2018 Shelby ..... A47C 19/025
2018/0049558 A1 * 2/2018 Jurcenko ..... A47G 9/0292
2018/0325273 A1 * 11/2018 Cailley ..... A47C 23/002

OTHER PUBLICATIONS

Written Opinion mailed Oct. 24, 2018 for Application No. PCT/US18/46005 (9 pages).
Notification Concerning Transmittal of International Preliminary Report on Patentability (Chapter I of the Patent Cooperation Treaty), issued in International Application No. PCT/US2018/046005, mailed Mar. 5, 2020; 7 pages.

* cited by examiner

MATTRESS FOUNDATION AND PROCESS OF MANUFACTURE

BACKGROUND

The present disclosure generally relates to mattress foundations and processes of manufacture, and more particularly, to mattress foundations including a laminated fabric covering and processes of manufacturing the same.

Conventional bedding systems commonly include a mattress supported by a foundation or "box spring". The foundations provide support and maintain the structural integrity of a mattress disposed thereon. Additionally, mattress foundations are generally configured to support the mattress in a raised position relative to the floor, i.e., ground.

Some foundations can be defined by a fabric covered and padded rectangular wooden frame that generally includes a planar support surface dimensioned to approximate the size of the intended mattress to be supported and a frame that is typically formed of multiple pieces affixed about a perimeter of the planar support surface. For aesthetics and comfort, the portions of the foundation that are visible to the consumer during us are oftentimes covered with a fabric covering that can further include padding intermediate the fabric covering and the visible portions of the foundation. Mattresses and mattress foundations are often sold as matched sets, in which case the fabric covering on the mattress foundation is typically matching or has complimentary colors and/or designs to that of the intended mattress. The fabric covering may be a single color or may be patterned to form one or more designs.

The width of the frame is typically 3 to 12 inches, although greater or smaller widths can be used. The frame can be mounted or attached to the planar support surface by gluing, stapling, heat fusion, fasteners or the like.

During manufacture of this type of foundation, the fabric covering is provided to each component after which the different components are assembled. Thus, where each component abuts another component of the foundation, a seam can be visible. Typically, the manufacturing process includes first cutting the fabric cutting (and padding, if present) followed by sewing to the dimensions of the particular component so as to sufficiently cover what will be the visible portion of the component and stapled thereto. Usually, an excess amount of the fabric covering relative to the component dimensions is provided so that fabric covering can be wrapped as well as stapling can be made to the non-visible portion. Once each component is covered in this manner, the different components are then assembled. These steps can be time consuming and leads to added costs associated with fabricating the rectangular wooden frame foundation.

The assembled wooden frame foundations are then sent to the consumer, distributor, or retailer. Because the foundations are fully assembled, the amount of space required to ship the fully assembled foundations can be relatively large not to mention cumbersome. The alternative is to ship the individual assembled components for final assembly at the point of use, which can be impractical and is generally not desired.

BRIEF SUMMARY

Disclosed herein are partially assembled mattress foundations, assembled mattress foundation and methods of manufacture.

In one or more embodiments, a partially assembled mattress foundation includes a foundation frame including a rigid planar support having a length and width dimension, rigid side frame members having a length dimension less than the planar support length dimension and in abutting relationship therewith, and rigid transverse frame members side frame members having a length dimension less than the planar support width dimension and in abutting relationship therewith, wherein the rigid side frame members and the rigid transverse frame members are centrally located with respect to the length and width dimensions, respectively, of the rigid planar support, wherein the foundation frame has top planar surfaces and bottom planar surfaces, and a single flexible fabric covering including a primary surface and tabs laterally extending from each end surface of the primary surface, wherein the primary surface has a length and width dimension effective to at least cover the length and width dimension of the rigid planar support and the tabs have a length and width dimension effective to at least cover the rigid side frame members and the rigid transverse frame members, wherein the single flexible fabric covering is fixedly attached to and covers at least the top planar surfaces of the foundation frame.

In one or more embodiments, a mattress foundation includes a foundation frame including a rigid planar support having a length and width dimension, rigid side frame members having a length dimension less than the planar support length dimension and in abutting relationship therewith, and rigid transverse frame members side frame members having a length dimension less than the planar support width dimension and in abutting relationship therewith, wherein the rigid side frame members and the rigid transverse frame members are centrally located with respect to the length and width dimensions, respectively, of the rigid planar support, wherein the foundation frame has top planar surfaces and bottom planar surfaces, and a single flexible fabric covering including a primary surface and tabs laterally extending from each end surface of the primary surface, wherein the primary surface has a length and width dimension effective to at least cover the length and width dimension of the rigid planar support and the tabs have a length and width dimension effective to at least cover the rigid side frame members and the rigid transverse frame members, wherein the single flexible fabric covering is fixedly attached to and covers at least the top planar surfaces of the foundation frame; and a corner guard attached to a respective end of the rigid side frame members and the rigid transverse frame members at each corner of the foundation frame, wherein the respective ends are at 90 degrees relative to one another.

In one or more embodiments, a process for forming a mattress foundation includes laminating a flexible fabric covering of a single piece construction onto at least a top planar surface of a foundation frame, the foundation frame comprising a rigid planar support having a length and width dimension, rigid side frame members having a length dimension less than the rigid planar support length dimension and in abutting relationship therewith, and rigid transverse frame members having a length dimension less than the rigid planar support width dimension and in abutting relationship therewith, wherein the rigid side frame members and the rigid transverse frame members are centrally located with respect to the length and width dimensions, respectively, of the rigid planar support.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
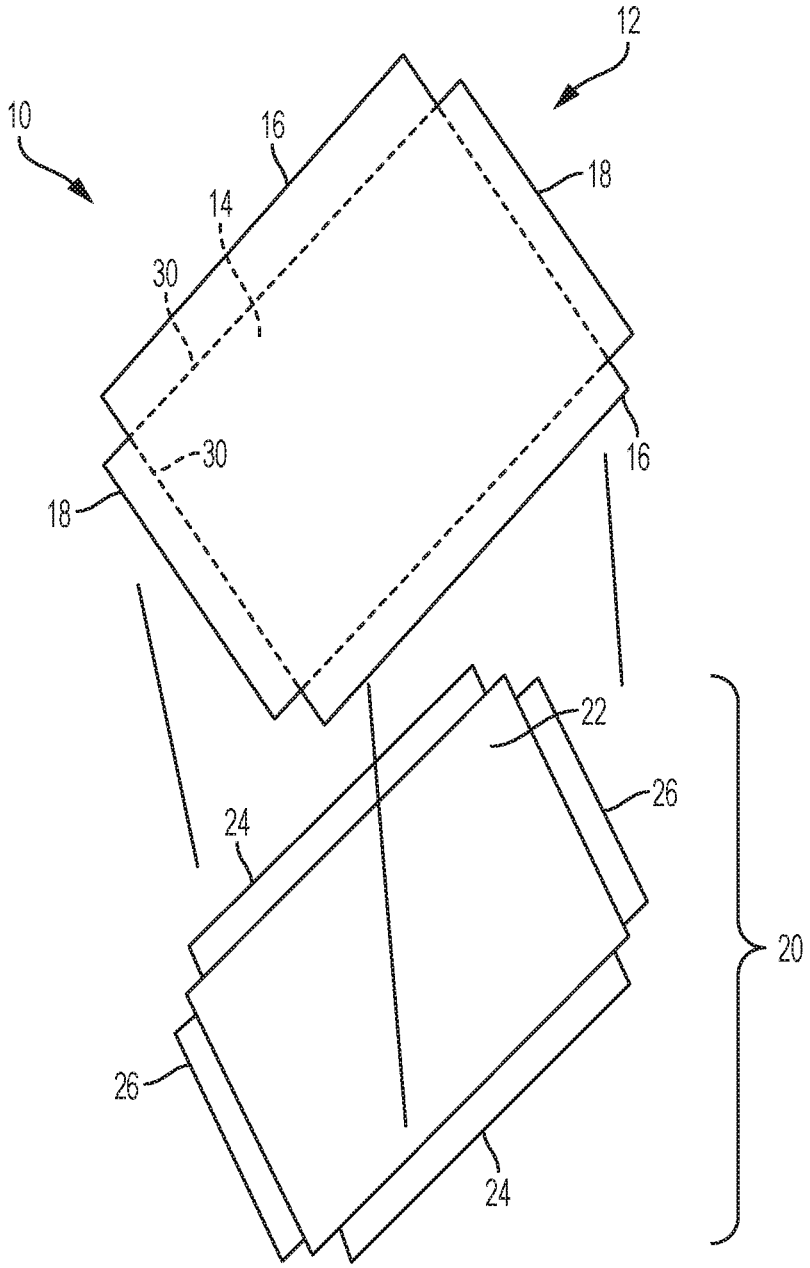
FIG. 1 illustrates an exploded perspective view of a partially assembled mattress foundation in accordance with the present disclosure.

FIG. 1 depicts an exploded perspective view of a partially assembled mattress foundation in accordance with the present disclosure generally designated by reference numeral 10. The partially assembled mattress foundation 10 generally includes a flexible fabric covering 12 and a foundation frame 20, wherein the fabric covering 12 is laminated directly to the foundation frame 20 as will be discussed in greater detail below.

The flexible fabric covering 12 is of a single piece construction and generally includes a rectangular shaped primary surface 14 that approximates the length and width dimensions of the intended mattress (not shown) upon which the primary surface contacts when fully assembled. Tabs 16, 18 of the fabric covering are centrally located about and laterally extending from each end surface about a perimeter of the primary rectangular shaped support surface 14. The tabs 16, 18 have a length dimension less than that of the respective length dimension of the primary rectangular shaped support surface 14. It should be noted that one or more layers of padding may be attached to an underside of the flexible fabric covering prior to lamination to the foundation frame.

The foundation frame 20 is defined by multiple discrete components includes a rigid planar support member 22, rigid side frame members 24, and rigid transverse frame members 26. When the fabric covering 12 is laminated to the foundation frame 20, the primary surface 14 of the fabric covering 12 effectively covers the top facing surface of the rigid planar support member 22, whereas tabs 18 of the fabric covering are dimensioned to effectively cover the side frame members 24, and tabs 16 of the fabric covering are dimensioned to effectively cover the transverse frame members 26. The transverse frame members 26 generally correspond to the head and foot sections of the mattress assembly.

The side frame members 24 and the transverse frame members 26 are centrally located with respect to each side of the planar support 22 and are positioned in an abutting relationship or in close proximity thereto prior to lamination such that subsequent to lamination the fabric covering functions as a hinge with respect to the side frame members 24 and transverse frame members 26 relative to the planar support 22 can occur. In one or more optional embodiments, the planar support 22 may be hingeably coupled using a hinge to the side frame members 24 and the transverse frame members 26 so as to provide increased structurally rigidity during handling and to prevent potential tearing of the fabric during assembly. The planar support 22 is generally rectangularly shaped and approximates the length and width dimensions of the intended mattress, which is similar to the dimensions of the rectangular shaped fabric surface 14. The respective lengths of the side frame members and the transverse frame members are equal to less than the corresponding length and width dimensions of the planar support 22. The planar support 22, side framing members 24, and transverse frame members 26 are formed of a rigid material such as wood, plastic, metal, cardboard, composites, or the like.

Figure 2:
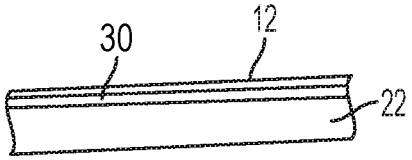
FIG. 2 illustrates an enlarged partial cross section of the fabric covering subsequent to lamination to the foundation frame in accordance with the present disclosure.

As noted above, the partially assembled mattress foundation 10 and process of manufacturing the same generally includes a laminating process, which can include applying an adhesive onto the exteriorly oriented surfaces of the planar support 22, side frame members 24, and transverse frame members 26 and/or on the underside of the fabric covering 12 defined by the single piece construction. Once the adhesive is applied, the fabric covering 12 is aligned with the various components of the foundation frame 20 as shown and contacted therewith. Pressure can be applied to improve adhesive contact. After the adhesive is cured, the partially assembled mattress foundation 10 is substantially flat and structurally stable, thereby minimizing space requirements for storage and/or when shipping from one location to another. FIG. 2 provides an enlarged partial cross sectional view of the fabric covering subsequent to lamination to the planar support 22 of the foundation frame 20. As shown, the laminated structure includes a portion of the rigid planar support 22, a layer of adhesive (e.g., glue) 30, and the fabric covering 12.

Figure 3:
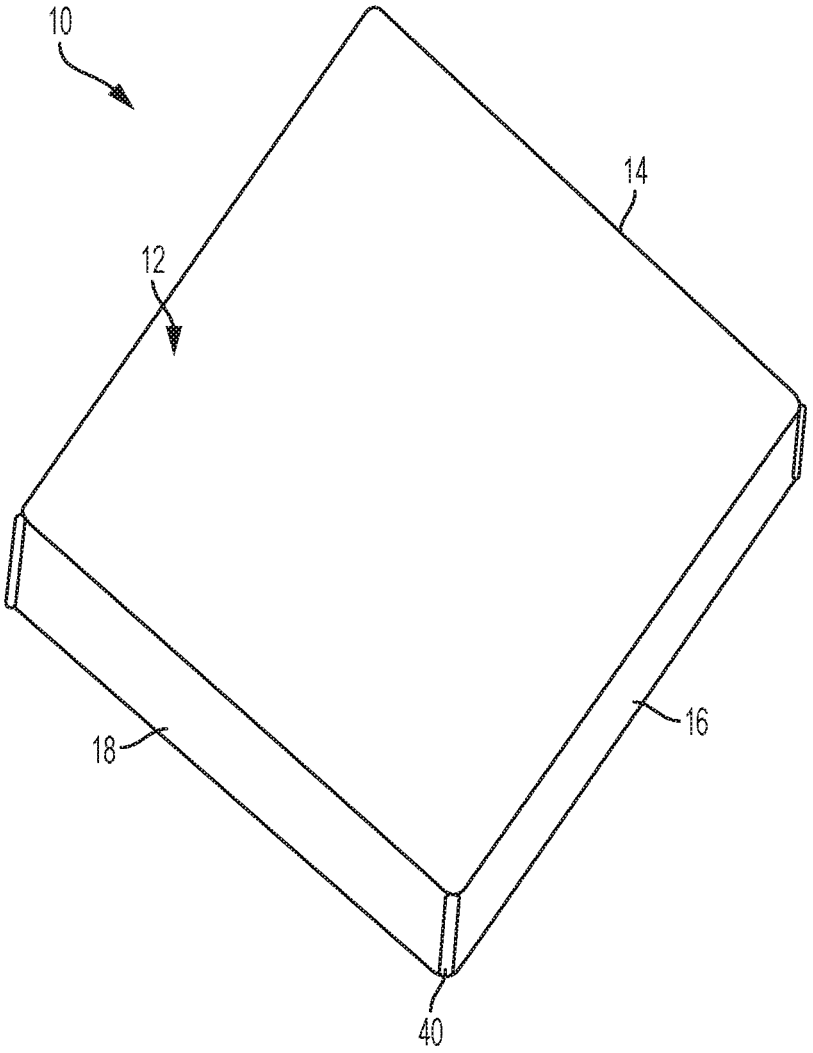
FIG. 3 illustrates a perspective view of an assembled mattress foundation in accordance with the present disclosure.

FIG. 3 provides a perspective view of an assembled mattress foundation 10. As previously discussed, the tabs 16, 18 of the fabric covering 12 function as a hinge as indicated at fold lines 30 (see FIG. 1) with respect to the side frame members 24 and the transverse frame members 26 relative to the rigid planar support 22. In this manner, the side frame members 24 and the transverse frame members 26 can be oriented perpendicular relative to the planar support 22 and about a peripheral edge of the planar support 12 when final assembly is desired. As discussed above, the planar support 22, side frame members 24, and transverse frame members 26 underlie the fabric covering 12, i.e., the primary surface 14 of the fabric covering covers the planar support, tabs 16 covers the side frame members 24, and tabs 18 cover the transverse frame members 26. A corner guard 40 having an arcuate exterior portion can be utilized to fasten the respective ends of the side frame members 24 to the transverse frame members 26 so as to provide a perpendicular relationship and form a box-like structure to the fabric covered foundation frame 10. In one or more embodiments, the corner guards 40 can include a clip that couples the respective ends of the side and transverse frame members 24, 26 to one another, which can include a flange that can be fastened to the non-visible portion (i.e., backside) of the side and transverse framing members so as to provide additional structural integrity and to form a frame about the peripheral edge of the planar support 22. The corner guard 40 can also be configured to cover any excess fabric covering at the intersecting edges of the framing members and the planar support to provide a more pleasing look. The corner guard 40 can be fixedly attached using a conventional fastener including glue, hook and loop fasteners, bolts, screws, and the like. The corner guards can be formed of any material but should be resistant to impacts. Optionally, legs (not shown) may be fastened at the corners to provide a desired amount of elevation to the planar support 22.

Figure 4:
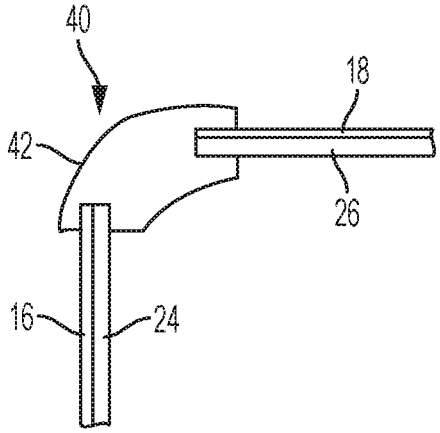
FIG. 4 illustrates a top down sectional view of an exemplary corner assembly.

FIG. 4 depicts a top down sectional view of an exemplary corner guard assembly 40. As shown, the corner guard 40 include includes an arcuate face 42 and clip openings configured to slideably receive ends of the fabric covered framing members 24, 26, which are covered with tabs 16, 18, respectively of the fabric covering 12. The corner guard 40 can be fixedly attached to the respective side and transverse framing member after sliding engagement using a conventional fastener including glue, hook and loop fasteners, bolts, screws, and the like.

The process of attaching the fabric covering 12 to the rigid planar support 22 and the side and transverse framing members 24, 26, respectively, generally includes laminating the fabric covering 12 onto the exteriorly oriented planar surfaces of the respective planar support 22 and the side and transverse framing members 24, 26, respectively. The partially assembled foundation can then be shipped or stored flat, wherein final assembly simply requires the operator to fold the four fabric covered side and transverse framing members 14 relative to the fabric covered planar support to form the rectangular shaped fabric covered frame about the peripheral edge of the planar support 22. The corners are then closed using the corner guards as described above to provide structural integrity. Additionally, these corner guards protect the fabric at the corners of the mattress foundation from being snagged or worn against the bed frame or against other objects when the mattress foundation is being moved.

Advantageously, lamination and assembly in this manner eliminates the time consuming fabric cutting and sewing operations required for assembly of prior art foundations, which applied the fabric covering to each individual component prior to assembly. Moreover, final assembly requiring the use of staples is eliminated as final assembly utilizing the one-piece laminated fabric covering is performed by folding the fabric covered side and transverse framing members 24, 26, respectively, and closing the intersecting corner with the corner guard 40 to provide structural integrity as well as improved aesthetics. Still further, the process fully avoids the cumbersome and costly cover fabrication and installation as well as it presents potential significant advantages if shipped flat to the customer.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A partially assembled mattress foundation, consisting of:

a foundation frame comprising a single rigid and inflexible planar support having a length and width dimension, rigid and inflexible side frame members having a length dimension less than the planar support length dimension and in abutting relationship therewith, and rigid and inflexible transverse frame members having a length dimension less than the planar support width dimension and in abutting relationship therewith, wherein the rigid side frame members and the rigid transverse frame members are centrally located with respect to the length and width dimensions, respectively, of the rigid planar support, wherein the foundation frame has top planar surfaces and bottom planar surfaces, wherein the foundation frame is formed of a material selected from the group consisting of wood, plastic, metal, cardboard and composites, and a single flexible fabric covering comprising a primary surface and tabs laterally extending from each end surface of the primary surface, wherein the primary surface has a length and width dimension effective to at least cover the length and width dimension of the rigid planar support and the tabs have a length and width dimension effective to at least cover outwardly facing surfaces of the rigid side frame members and the rigid transverse frame members when assembled, wherein the single flexible fabric covering is laminated with an adhesive to and covers an outer facing surface of at least the top planar surfaces of the foundation frame such that the side frame members and the rigid transverse members are hingedly attached to the single rigid planar support by only the single flexible fabric and is free of any fabric seams between the side frame members and the rigid transverse members relative to the single rigid planar support, wherein the rigid side and transverse frame members are configured to be coplanar to the rigid planar support for storage or shipment, or are configured to be perpendicular thereto for assembly.

2. The partially assembled mattress foundation of claim 1, wherein the single flexible fabric covering has a shape slightly larger than a shape defined by the top planar surfaces of the foundation frame.

3. The partially assembled mattress of claim 1, wherein the lengths and widths of the primary surface of the fabric covering and the rigid planar support of the foundation frame approximate a length and a width dimension of a mattress to be disposed thereon.

4. The partially assembled mattress of claim 1, wherein the foundation frame further comprises a hinge coupling each of the rigid side frame members and the rigid transverse frame members to the rigid planar support.

5. A mattress foundation consisting of:

a foundation frame comprising a single rigid and inflexible planar support having a length and width dimension, rigid s and inflexible ide frame members having a length dimension less than the planar support length dimension and in abutting relationship therewith, and rigid and inflexible transverse frame members side frame members having a length dimension less than the planar support width dimension and in abutting relationship therewith, wherein the rigid side frame members and the rigid transverse frame members are centrally located with respect to the length and width dimensions, respectively, of the rigid planar support, wherein the foundation frame has top planar surfaces and bottom planar surfaces, wherein the foundation frame is formed of a material selected from the group consisting of wood, plastic, metal, cardboard and composites, and a single flexible fabric covering comprising a primary surface and tabs laterally extending from each end surface of the primary surface, wherein the primary surface has a length and width dimension effective to at least cover the length and width dimension of the rigid planar support and the tabs have a length and width dimension effective to at least cover the rigid side frame members and the rigid transverse frame members, wherein the single flexible fabric covering is fixedly adhered to and covers outwardly facing surfaces of at least the top planar surfaces of the foundation frame and the rigid transverse and side frame members such that the side frame members and the rigid transverse members are hingedly attached to the single rigid planar support by the single flexible fabric covering and free of any fabric seams between the side frame members and the rigid transvers members relative to the single rigid planar support, wherein the rigid side and transverse frame members are configured to be coplanar to the rigid planar support for storage or shipment, or are configured to be perpendicular thereto for assembly; and a corner guard attached to a respective end of the rigid side frame members and the rigid transverse frame members at each corner of the foundation frame, wherein the respective ends are at 90 degrees relative to one another.

6. The mattress foundation of claim 5, wherein the corner guard includes an arcuate exterior face.

* * * * *